US006200172B1

(12) United States Patent
Konoya et al.

(10) Patent No.: US 6,200,172 B1
(45) Date of Patent: Mar. 13, 2001

(54) ELECTRICAL CONNECTOR HAVING A HOUSING AND A RETAINER

(75) Inventors: Hisashi Konoya; Hideto Nakamura, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/275,879

(22) Filed: Mar. 25, 1999

(30) Foreign Application Priority Data

Mar. 27, 1998 (JP) ..... 10-081948
Apr. 14, 1998 (JP) ..... 10-103042

(51) Int. Cl.[7] ..... H01R 13/436
(52) U.S. Cl. ..... 439/752
(58) Field of Search ..... 439/752, 595

(56) References Cited

U.S. PATENT DOCUMENTS 4,867,712 9/1989 Kato et al. ..... 439/752
5,516,308 * 5/1996 Yamanashi ..... 439/752
5,647,775 * 7/1997 Polgar et al. ..... 439/752

FOREIGN PATENT DOCUMENTS 64-54678 3/1989 (JP) .

* cited by examiner

*Primary Examiner*—Gary Paumen
(74) *Attorney, Agent, or Firm*—Oliff & Berridge, PLC

(57) ABSTRACT

A connector includes a housing for receiving electrical terminals and a retainer for retaining the terminals in the housing. The retainer has a plate-shaped body and a pair of reinforcing wall portions that slidingly contact an outer surface of the housing. The reinforcing wall portions are at right and left ends of the plate-shaped body, respectively. When the retainer is placed at a temporary position on the housing and a pressing force is applied to only the one end of the plate-shaped body, only the pressed side of the reinforcing wall portion moves to a locking position. As a result, the plate-shaped body inclines with respect to the upper surface of the housing. At this time, the plate-shaped body and the reinforcing wall portion elastically stretch. This stretch generates an elastic restoring force that urges the plate-shaped body to become parallel with the upper surface of the housing. As a result, the other side of the reinforcing wall portion moves downward, and the retainer reaches the locking position on both sides.

7 Claims, 5 Drawing Sheets

ELECTRICAL CONNECTOR HAVING A HOUSING AND A RETAINER

BACKGROUND OF THE INVENTION

1. Field of Invention

The present invention relates to an electrical connector that includes a housing for receiving at least one electrical terminal, and a retainer connectable to the housing to retain the terminal therein. The connector is intended principally for use in an electrical system of a vehicle, such as an automobile.

2. Description of Related Art

FIG. 5 shows a known connector component disclosed in Laid-Open Japanese Patent Publication No. 64-54678. For simplicity, in this application a connector component is referred to simply as a "connector". The connector of FIG. 5 includes a housing 1 and a retainer 3. The retainer is installed on a side surface of the housing, and is used for the secondary locking of one or more electrical terminals to the housing. Specifically, the housing 1 includes a cavity. The cavity has an installing aperture 2 of a length greater than its width. The retainer 3 comprises a rectangular plate-shaped body 2A which is shaped to fit the installing aperture 2. The retainer further comprises removal prevention portions 2B which project from one surface of the plate-shaped body 2A, and a pair of locking pieces 2C projecting from respective ends of the plate-shaped body 2A.

To assemble the connector, the housing 1 and retainer 3 are first arranged in the temporary position shown in cross-section in FIG. 5(*a*). Subsequently, as shown, one or more electrical terminals 4 are inserted into the cavity of the housing 1 via further apertures out of the plane of FIG. 5(*a*). Then, the retainer 3 is pressed into a locking position shown in FIG. 5B. In this locking position, the removal prevention portions 2B prevent the terminals 4 from being removed from their correct locked position within the cavity.

The retainer 3 is pressed from the temporary position into the locking position by application of force onto the upper surface of the plate-shaped body 2A. However, if inadvertently only the right end or the left end of the plate-shaped body 2A (as viewed in FIG. 5) is pressed, only that end of the locking piece 2C moves to a position corresponding to the locking position. Such a state is shown in FIG. 5C. As a result, the retainer 3 may be installed on housing 1 with the plate-shaped body 2A inclined. This means that the terminals 4 are not correctly locked to the housing.

SUMMARY OF THE INVENTION

The present invention has been made in view of the above-described problem. It is an object of the present invention to provide a connector in which a retainer is less liable to be installed on a housing in an inclined orientation, and thus improve the locking of a terminal to the housing.

In order to achieve the above, the present invention provides a connector including a housing into which at least one electrical terminal can be inserted in an insertion direction and a retainer that can be installed on the housing by a motion in a direction substantially perpendicular to the insertion direction. The retainer has a plate-shaped body and at least one removal prevention portion projecting from the plate-shaped body. When the retainer is installed on the housing, the plate-shaped body is substantially parallel with an outer surface of the housing. During the installation action, the retainer moves from a temporary position, in which the terminal can be inserted into and removed from the housing, to a locking position, in which the removal prevention portion prevents the terminal from being removed from a predetermined position within the housing. The retainer can be moved from the temporary position to the locking position by pressing the plate-shaped body toward the housing. A pair of reinforcing wall portions are formed on respective ends of the plate-shaped body such that the reinforcing wall portions project from the plate-shaped body in a direction generally parallel to the direction of projection of the removal prevention portions, and are elastically flexible outward. The reinforcing wall portions make sliding contact with the outer surface of the housing when the retainer is shifted from the temporary position to the locking position.

If only one end of the plate-shaped body is pressed when it is desired to move the retainer from the temporary position to the locking position and the plate-shaped body reaches an inclined configuration, the plate-shaped body is elastically flexed relative to the reinforcing wall portion at the end which was pressed. As a result, an elastic restoring force urges the plate-shaped body to become parallel to the outer surface of the housing. Consequently, the other end of the plate-shaped body (i.e., the end that was not pressed) shifts to the locking position.

This self-correcting effect has been found to be particularly effective if the reinforcing wall portions are longer than the removal prevention portions, that is if they extend further from the plate-shaped body than the removal prevention portions. For example, they may extend between two to four times further from the plate-shaped body than the removal prevention portions, and more preferably three to four times further.

Preferably, at least one recessed portion for accommodating a respective reinforcing wall portion is formed in the outer surface of the housing, in the region of the outer surface of the housing on which the reinforcing wall portion slides.

Because the recessed portion accommodates the reinforcing wall portion, the reinforcing wall portion does not project from the outer surface of the housing.

Preferably, the length of each recessed portion in the insertion direction is substantially the same as, or more than, that of the respective reinforcing wall portion in the projection direction from the plate-shaped body, so that the reinforcing wall portion can be fully received into the recessed portion and substantially fills the recessed portion.

Preferably, the thickness of the reinforcing wall portion (i.e., in the direction in which the reinforcing wall portions are spaced apart) is substantially equal to, or less than, the depth of the recessed portion, so that when the reinforcing wall portion is inserted into the recessed portion the outer surface of the reinforcing wall portion is flush with the outer surface of the housing proximate the recessed portion.

Furthermore, preferably the or each recessed portion includes a guide portion extending in the direction in which the reinforcing wall portion slides. This guide portion may, for example, be a side wall of the recessed portion. As the retainer is moved from the temporary position to the locking position, each reinforcing wall portion is guided along the respective guide portion. This helps to prevent the reinforcing wall portion from rotating in its plane. Thus, the correct positioning of the retainer is facilitated.

At least one of the retainer and the housing (preferably both) are preferably formed of polybutylene terephthalate (PBT), for example by injection molding. Suitable PBT has a bending elastic modulus of 2500 MPa.

BRIEF DESCRIPTION OF THE DRAWINGS

A non-limiting example of the invention will now be described with reference to the following drawings wherein.

DETAILED DESCRIPTION OF PREFERRED EMBODIMENTS

An embodiment of the present invention will be described below with reference to FIGS. 1 to 4.

The connector includes a housing 10 and a retainer 20, each made of a synthetic resin such as polybutylene terephthalate (PBT), for example by injection molding. The retainer 20 can be installed on the housing 10.

Figure 1:
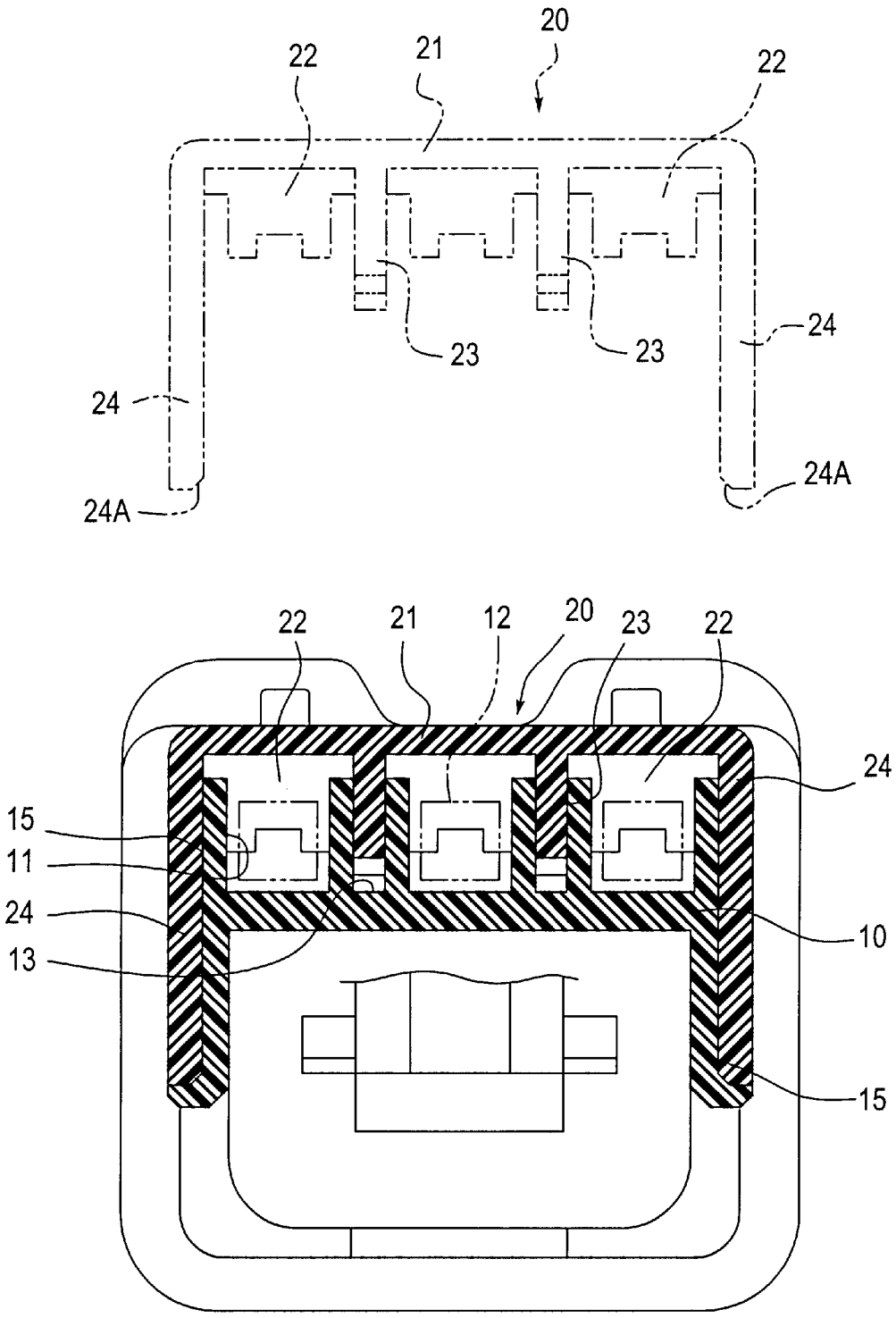
FIG. 1 is a cross-sectional view of a connector according to an embodiment of the present invention. The retainer is shown in dashed lines separated from the housing, and is shown in solid lines in the locking position.
Figure 2:
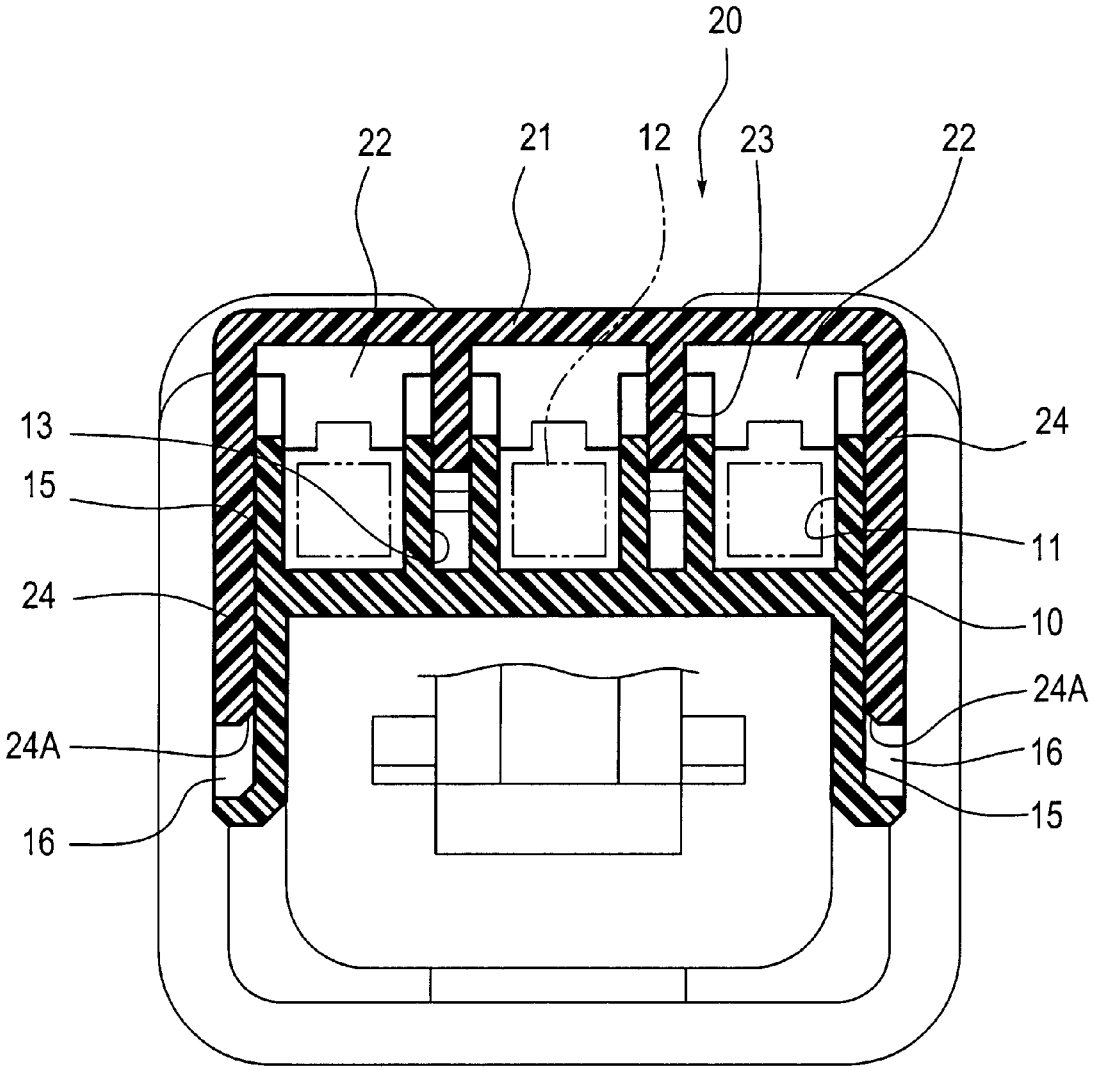
FIG. 2 is a cross-sectional view of the connector of FIG. 1 with the retainer in the temporary position.
Figure 4:
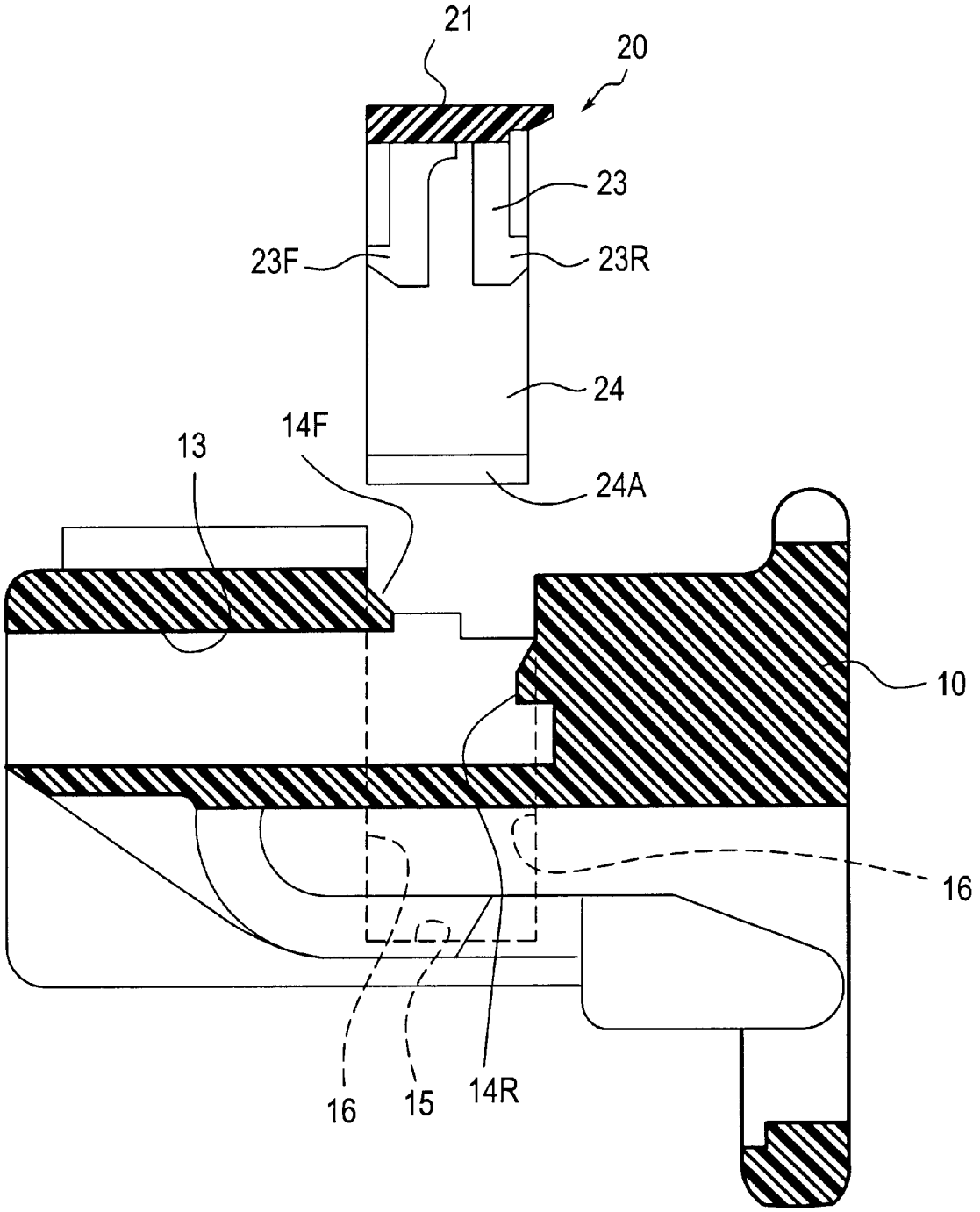
FIG. 4 shows the connector of FIG. 1, as viewed in cross-section in a plane perpendicular to the sectional view of FIG. 1. The retainer is shown separated from the housing.
Figure 5A:
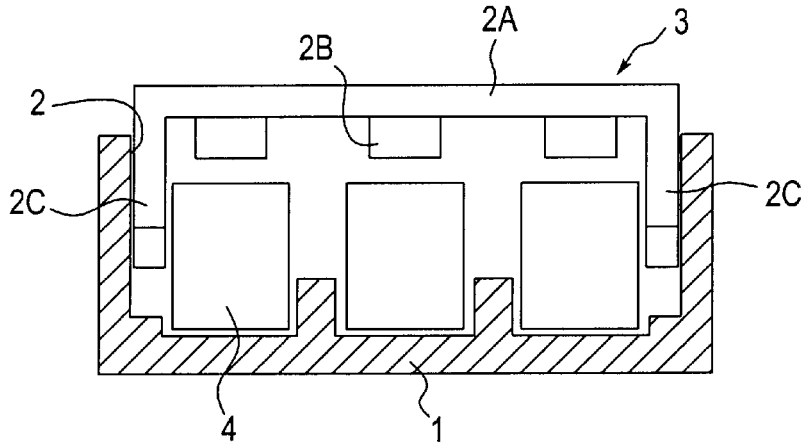
FIG. 5A PRIOR ART
FIG. 5A is a cross sectional view of a conventional connector, with the retainer located at a temporary position.
Figure 5B:
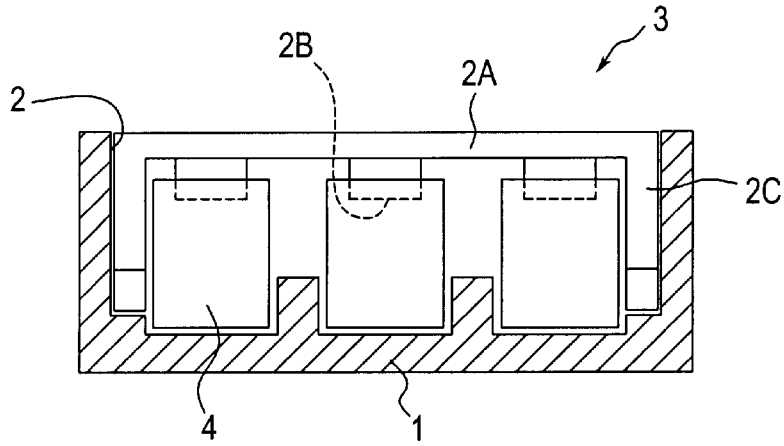
FIG. 5B PRIOR ART
FIG. 5B is a cross sectional view of the conventional connector of FIG. 5A, with the retainer located at a locking position.
Figure 5C:
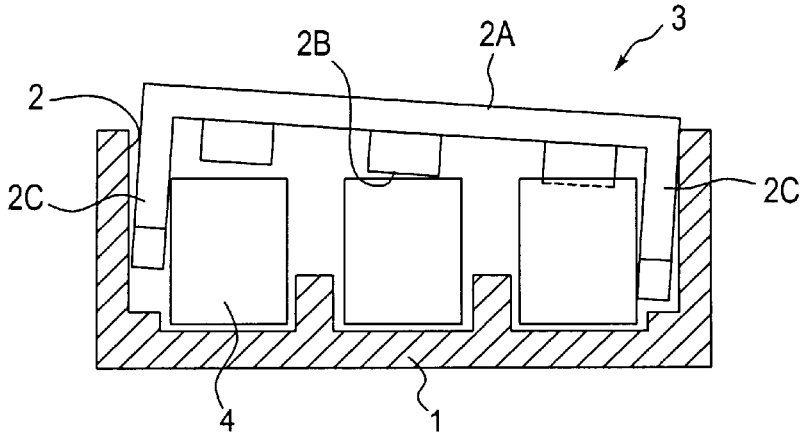
FIG. 5C PRIOR ART
FIG. 5C is a cross sectional view of the conventional connector of FIG. 5A, with the retainer located at an oblique position.

The housing 10 has a cavity including three chambers 11 arranged in its widthwise direction (i.e. the right-to-left direction in FIG. 1). FIG. 4 is a sectional view in a plane perpendicular to this widthwise direction. The three chambers penetrate through the housing in its lengthwise direction (i.e., the right-to-left direction in FIG. 4). An electrical terminal 10 is inserted into each chamber 11 through an opening in the rear of the housing 10 (i.e. opening towards the right side of FIG. 4). The central part of each chamber 11 (as measured along the lengthwise direction of the housing 10) is open towards the upper surface of the housing 10.

A pair of right and left slit-shaped installing apertures 13 extend vertically (i.e. towards the top of FIG. 1), each being between two adjacent chambers 11. Each installing aperture 13 is open at the front end of the housing 10 and extends to approximately the center of the housing 10 (as measured in its lengthwise direction). A rear end portion of each installing aperture is open towards the upper surface of the housing 10. A pair of front and rear locking projections 14F and 14R, respectively for locking the retainer 20 at the temporary position and at the locking position, are formed at the rear end of each installing aperture 13.

To reiterate, the chambers 11 and the installing apertures 13 alternate in the widthwise direction (i.e, the right-to-left direction on FIG. 1) of the housing 10, and all are open towards the upper surface of the housing.

A pair of shallow recessed portions 15 are formed respectively on the right and left outer side surfaces of the housing 10. Each recessed portion 15 is coincident with the cavity 11 and the installing aperture 13 as measured in the lengthwise direction of the housing 10. Each recessed portion 15 accommodates a respective reinforcing wall portion 24 of the retainer 20. The front and rear sides of the recessed portion 15 each serve as a vertical guide portion 16. The reinforcing wall portion 24 is guided downward by the guide portions 16, as each of the front and rear ends of the reinforcing wall portion 24 slides downward against the respective guide portion 16.

The retainer 20 will be described below.

The retainer 20 comprises a rectangular plate-shaped body 21 which, in the arrangement of FIG. 1, has its long sides parallel to the right-left direction of FIG. 1. The body 21 can be fitted against the chambers 11 and the installing aperture 13 (which as explained above all open towards the upper surface of the housing 10). Three removal prevention portions 22 project downward an equal distance from the lower surface of the plate-shaped body 21 at positions which each correspond to a respective chamber 11, and a pair of right and left locking pieces 23 project downward from the lower surface of the plate-shaped body 21 at positions which each correspond to a respective installing aperture 13.

Each locking piece 23 has a width equal to that of the respective installing aperture 13. Each locking piece 23 has a pair of front and rear locking claws 23F and 23R. In the temporary position of the retainer 20, each front locking claw 23F engages a respective front projection 14F of the housing 10, with the front locking claw 23F located above the front projection 14F, and each rear locking claw 23R engages a respective rear projection 14R of the housing 10, with the rear locking claw 23R located below the rear projection 14R. This keeps the retainer 20 at the temporary position shown in FIG. 2. When the retainer 20 is located at the temporary position, each removal prevention portion 22 is located above a respective terminal 12. Thus, the terminal 12 can be inserted into the cavity 11 and removed therefrom, and the upper surface of the plate-shaped body 21 is spaced by a certain distance from the upper surface of the housing 10.

When the retainer 20 located at the temporary position is pressed downward, the rear locking claw 23R engages the rear projection 14R, with the rear locking claw 23R located below the rear projection 14R, thus holding the retainer 20 at the locking position shown in FIG. 1. When the retainer 20 is located at the locking position, the outer surface of the plate-shaped body 21 is flush with the upper surface of the housing 10.

When the retainer 20 is located at the locking position, each removal prevention portion 22 projects into the insertion/removal path of the respective terminal 12. Therefore, if all the terminals 12 have been inserted into their respective predetermined positions, each removal prevention portion 22 locks a respective terminal 12 from the rear, thus locking the terminal 12 into the chamber 11 at its predetermined position. If any of the terminals 12 has not been fully inserted into its predetermined position by the time the user attempts to move the retainer 20 from the temporary position to the locking position, the respective removal prevention portion 22 engages the upper surface of the terminal 12. Thus, the retainer 20 is prevented from moving into the locking position.

As explained below, the connector is designed to make it hard to install the retainer 20 on the housing 10 with the retainer 20 inclined with respect to the housing 10.

Figure 3:
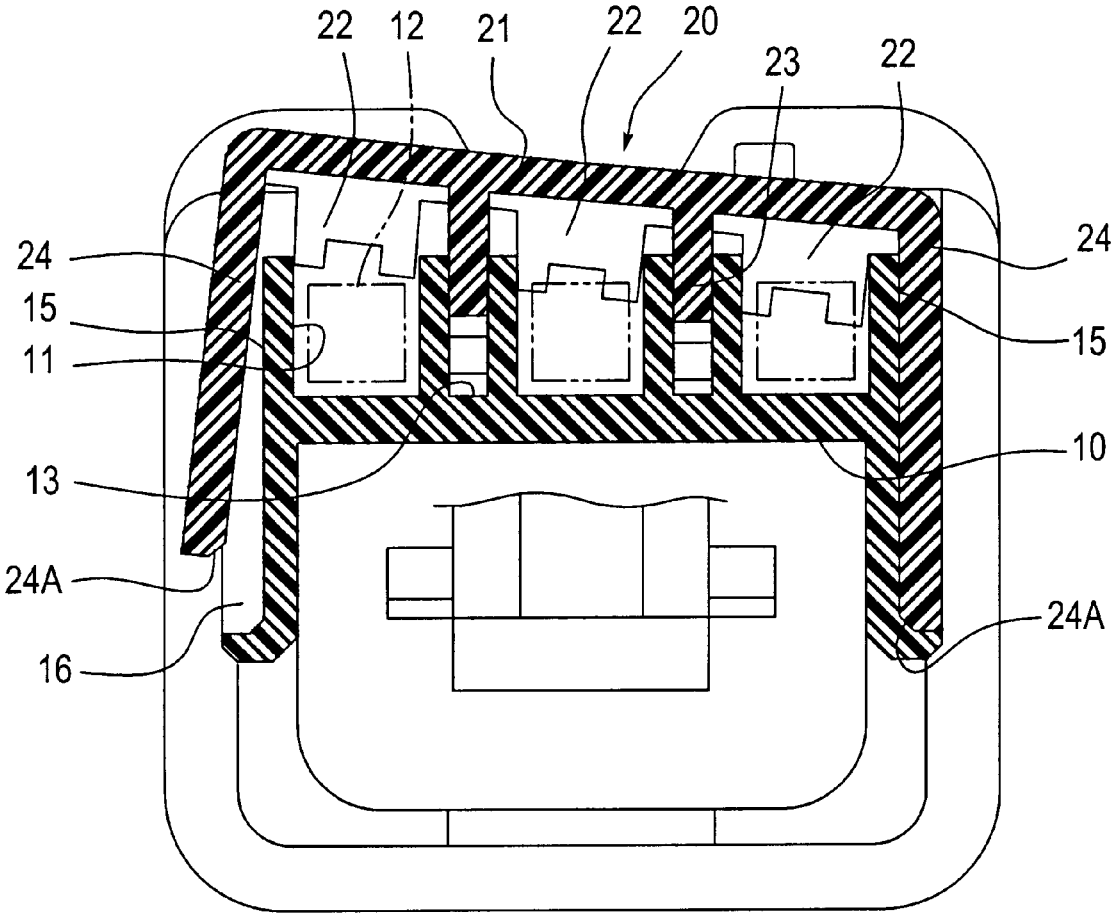
FIG. 3 is a cross-sectional view of the connector of FIG. 1 with the retainer in an oblique configuration.

The pair of reinforcing wall portions 24 extend by an equal distance perpendicular to the right and left edges of the plate-shaped body 21. Each of the pair of reinforcing wall portions 24 is in close sliding contact with a respective recessed portion 15 of the housing 10 when the retainer 20 is located at the temporary position or in the locking position. That is, the pair of reinforcing wall portions 24 closely embrace the housing 10, thus preventing the retainer 20 from moving widthwise with respect to the housing 10. Each reinforcing wall portion 24 is elastically flexible outward (i.e., in the widthwise direction) with respect to the plate-shaped body 21.A tapered guide slope 24A is formed at the inner side of the lower end of each reinforcing wall portion 24 to allow the lower end thereof to be smoothly fitted into the recessed portion 15. The thickness of each reinforcing wall portion 24 is equal to the depth of the respective recessed portion 15 in the widthwise direction (i.e., the right-to-left direction in FIGS. 1–3). Thus, the outer surface of the reinforcing wall portion 24 is flush with the outer surface of the housing 10 proximate the recessed portions 15.Each of the front and rear ends of each reinforcing wall portion 24 are in close sliding contact with a respective guide portion 16, thus preventing the retainer 20 from moving parallel to the length direction of the housing 10, and from becoming inclined with respect to the housing 10 by rotation about an axis parallel to the widthwise direction of the housing. Thus, the retainer 20 can be moved vertically parallel to the side surface of the housing 10 between the temporary position and the locking position, with the retainer 20 keeping a predetermined orientation with respect to the housing.In assembling the connector, each terminal 12 is inserted into its respective chamber 11, with the retainer 20 in the temporary position illustrated in FIG. 2. Then, the retainer 20 is pressed downward by an operator's fingers pressing on the upper surface of the plate-shaped body 21. As a result, the retainer 20 moves to the locking position, with the reinforcing wall portion 24 thereof sliding on the walls of the recessed portion 15.It is desirable to apply a uniform downward force to the plate-shaped body 21 in order to move the retainer 20 from the temporary position to the locking position, so that the retainer 20 does not incline widthwise with respect to the plate-shaped body 21 (i.e, by rotation about an axis parallel to the lengthwise direction of the housing). In the embodiment, when a pressing force is applied to only the right end of the plate-shaped body 21, or only to the left end thereof, the retainer 20 can be moved to the locking position reliably.For example, as shown in FIG. 3, when a pressing force is applied to only the right end of the plate-shaped body 21, only the right side of the reinforcing wall portion 24 is moved downward along the recessed portion 15 to a position corresponding to the locking position. The left side of the reinforcing wall portion 24 is not moved from its position in the temporary position, because the pressing force is not directly applied to it. As a result, the plate-shaped body 21 inclines, with the right side located lower than the left side. At this time, because each locking piece 23 is fitted in the installing aperture 13, and therefore is prevented from moving in the widthwise direction (the right-to-left direction on FIG. 1) within the installing aperture 13, the right side of the reinforcing wall portion 24 remains in close contact with the recessed portion 15. Accordingly, the plate-shaped body 21 and the right side reinforcing wall portion 24 are elastically stretched. Consequently, an elastic restoring force is generated that urges the body 21 in a closing direction (i.e., urges the plate-shaped body 21 and the right side reinforcing wall portion 24 to become perpendicular to each other). The elastic restoring force urges the plate-shaped body 21 to become parallel with the upper surface of the housing 10. As a result, the left side of the locking piece 23 is forced into the locking position. That is, the retainer 20 is forced into the locking position. During the above-described operation, the left side reinforcing wall portion 24 remains almost perpendicular to the plate-shaped body 21.As described above, the reinforcing wall portion 24 generates an elastic restoring force between the plate-shaped body 21 and the reinforcing wall portion 24 when the plate-shaped body 21 is inclined. Thus, even if only one side of the plate-shaped body 21 is pressed downward, it is possible to move the retainer 20 to the locking position.Furthermore, each recessed portion 15 of the housing 10 is so formed that it fully receives the respective reinforcing wall portion 24, so the outer surface of the reinforcing wall portion 24 is flush with the outer surface of the housing 10. Thus, a mating connector (not shown) can be installed on the housing 10 without the reinforcing wall portion 24 interfering with the mating connector.The guide portions 16 formed on the recessed portion 15 prevent the retainer 20 from moving lengthwise or inclining. Thus, the retainer 20 can be moved from the temporary position to the locking position reliably. The present invention is not limited to the embodiment described above with reference to the drawings. For example, the following modifications may be made within the spirit and scope of the present invention.

(1) Although recessed portions are formed on the outer surface of the housing in the embodiment, it is possible to construct a housing according to the invention without forming a recessed portion.

(2) Although guide portions are formed on the outer surface of the housing in the embodiment, it is possible to construct a housing according to the invention without forming a guide portion.

What is claimed is: 1. A connector comprising:

a housing that receives at least one electrical terminal in an insertion direction, said housing having an outer surface;

a retainer that can be installed on said housing by a motion toward said housing in a direction substantially perpendicular to said insertion direction, the retainer including a plate-shaped body, a pair of reinforcing wall portions formed at respective ends of said plate-shaped body, at least one removal prevention portion projecting from the plate-shaped body between the pair of reinforcing wall portions that prevents the at least one electrical terminal from being removed from the housing, at least one locking piece that locks the retainer in the housing, said reinforcing wall portions projecting from said plate-shaped body in a direction generally parallel to the direction of projection of said at least one removal prevention portion, said retainer being movable by said motion from a temporary position at which the retainer does not prevent insertion and removal of said at least one terminal into or out of said housing, to a locking position at which said at least one removal prevention portion prevents said at least one terminal from being removed from a predetermined position within the housing, a surface of said plate-shaped body being parallel with a proximate portion of said outer surface of said housing when said retainer is in said locking position, wherein said reinforcing wall portions are elastically flexible outward and slidingly contact said outer surface of said housing as said retainer moves from said temporary position to said locking position; and at least one recessed portion that accommodates a respective said reinforcing wall portion formed on said outer surface of said housing, in a region of the outer surface of the housing on which the respective reinforcing wall portion slides. 2. A connector according to claim 1, wherein said reinforcing wall portions extend further from said plate-shaped body than said at least one removal prevention portion.3. A connector according to claim 1, wherein a length of each said recessed portion in said insertion direction is at least substantially equal to an extent of the projection of the respective reinforcing wall portion extending from the plate-shaped body.4. A connector according to claim 1, wherein a thickness of each reinforcing wall portion is at most substantially equal to a depth of the respective recessed portion.5. A connector according to claim 1, wherein at least one guide portion is formed in each recessed portion, the guide portion extending in the direction in which the respective reinforcing wall portion slides.6. A connector according to claim 1, wherein at least one of the housing and the retainer is made of polybutylene terephthalate. 7. A connector according to claim 1, further comprising at least one locking claw on said retainer that engages a corresponding locking projection on said housing to retain said retainer at the temporary position and the locking position.

* * * * *